United States Patent [19]

Picone et al.

[11] Patent Number: 4,815,134

[45] Date of Patent: Mar. 21, 1989

[54] VERY LOW RATE SPEECH ENCODER AND DECODER

[75] Inventors: Joseph W. Picone; George R. Doddington, both of Richardson, Tex.

[73] Assignee: Texas Instruments Incorporated, Dallas, Tex.

[21] Appl. No.: 94,162

[22] Filed: Sep. 8, 1987

[51] Int. Cl.[4] ..... G10L 3/02

[52] U.S. Cl. ..... 381/31; 381/36

[58] Field of Search ..... 381/29, 30, 31, 34, 381/35, 36

[56] References Cited

U.S. PATENT DOCUMENTS

| | | | |
|---|---|---|---|
| 4,216,354 | 8/1980 | Esteban et al. | 381/31 |
| 4,386,237 | 5/1983 | Virupaksha et al. | 381/31 |
| 4,718,087 | 1/1988 | Papamichalis | 381/31 X |
| 4,742,550 | 5/1988 | Fette | 381/36 |

OTHER PUBLICATIONS

Jayant, "Coding Speech at Low Bit Rates", IEEE Spectrum, Aug. 1986.

*Primary Examiner*—Patrick R. Salce
*Assistant Examiner*—Marc S. Hoff
*Attorney, Agent, or Firm*—William E. Hiller; N. Rhys Merrett; Melvin Sharp

[57] ABSTRACT

A speech encoder is disclosed quantizing speech information with respect to energy, voicing and pitch parameters to provide a fixed number of bits per block of frames. Coding of the parameters takes place for each N frames, which comprise a block, irrespective of phonemic boundaries. Certain frames of speech information are discarded during transmission, if such information is substantially duplicated in an adjacent frame. A very low data rate transmission system is thus provided which exhibits a high degree of fidelity and throughput.

25 Claims, 1 Drawing Sheet

VERY LOW RATE SPEECH ENCODER AND DECODER

TECHNICAL FIELD OF THE INVENTION

The present invention relates in general to speech processing methods and apparatus, and more particularly relates to methods and apparatus for encoding and decoding speech information for digital transmission at a very low rate, without substantially degrading the fidelity or intelligibility of the information.

BACKGROUND OF THE INVENTION

The transmission of information by digital techniques is becoming the preferred mode of communicating voice and data information. High speed computers and processors, and associated modems and related transmission equipment, are well adapted for transmitting information at high data rates. Telecommunications and other types of systems are well adapted for transmitting voice information at data rates upwardly of 64 kilobits per second. By utilizing multiplexing techniques, transmission mediums are able to transmit information at even higher data rates.

While the foregoing represents one end of an information communication spectrum, there is also a need for providing communications at low or very low data rates. Underwater and low speed magnetic transmission mediums represent situations in which communications at low data rate are needed. The problems attendant with low data rate transmissions is that it is difficult to fully characterize an analog voice signal, or the like, with a minimum amount of data sufficient to accommodate the very low transmission data rate. For example, in order to fully characterize speech signals by pulse amplitude modulation techniques, a sampling rate of about 8 kHz is necessary. Obviously, digital signals corresponding to each pulse amplitude modulated sample cannot be transmitted at very low transmission bit rates, i.e., 200–1200 bits per second. While some of the digital signals could be excluded from transmission to reduce the bit rate, information concerning the speech signals would be lost, thereby degrading the intelligibility of such signals at the receiver.

Various approaches have been taken to compress speech information for transmission at a very low data rate without compromising the quality or intelligibility of the speech information. To do this, the dynamic characteristics of speech signals are exploited in order to encode and transmit only those characteristics of the speech signals which are essential in maintaining the intelligibility thereof when transmitted at very low data rates. Quantization of continuous-amplitude signals into a set of discrete amplitudes is one technique for compressing speech signals for very low data rate transmissions. When each of a set of signal value parameters are quantized, the result is known as scalar quantization. When a set of parameters is quantized jointly as a single vector, the process is known as vector quantization. Scalar and vector quantization techniques have been utilized to transmit speech information at low data rates, while maintaining acceptable speech intelligibility and quality. Such techniques are disclosed in the technical article "Vector Quantization In Speech Coding", *Proceedings of the IEEE*, Vol. 73, No. 11, Nov., 1985.

Matrix quantization of speech signals is also well-known in the art for deriving essential characteristics of speech information. Matrix quantization techniques require a large number of matrices to characterize the speech information, thereby being processor and storage intensive, and not well adapted for low data rate transmission. A significant degradation of the intelligibility of the speech information results when employing matrix quantization and low data rate transmissions.

When vector quantizing a signal for transmission, a vector "X" is mapped onto another real-valued, discrete-amplitude, N-dimensional vector "Y". Typically, the vector "Y" takes on one definite set of values referred to as a codebook. The vectors comprising the codebook are utilized at the transmitting and receiving ends of the transmission system. Hence, when a number of parameters characteristic of the speech information are mapped into one of the codebook vectors, only the codebook vectors need to be transmitted to thereby reduce the bit rate of the transmission system. The reverse operation occurs at the receiver end, whereupon the vector of the codebook is mapped back into the appropriate parameters for decoding and resynthesizing into an audio signal. While matrix quantization offers one technique for compressing speech information, the intelligibility suffers, in that one generally cannot discriminate between speakers.

From the foregoing, it can be seen that a need exists for a speech compression technique compatible with data rates on the order of 400 bits per second, without compromising speech quality or intelligibility. An associated need exists for a speech compression technique which is cost-effective, relatively uncomplicated and can be carried out utilizing present day technology.

SUMMARY OF THE INVENTION

In accordance with the present invention, the disclosed speech compression method and apparatus substantially reduces or eliminates the disadvantages and shortcomings associated with the prior art techniques. According to the invention, the speech signals are digitized and framed, and a number of frames are encoded without regard to phonemic boundaries to provide a fixed data rate encoding system. The technical advantage thereby presented is that the system is more immune to transmission noise, and such a technique is well adapted for self-synchronization when used in synchronized systems. Another technical advantage presented by the invention is that a low data rate system is provided, but without substantially compromising the quality of the speech, as is characteristic with low data rate systems heretofore known. Yet another technical advantage of the invention is that a very low data rate can be achieved by eliminating the processing and encoding of certain frames of speech information, if the neighboring frames are characterized by the substantially same information. A few bits are then transmitted to the receiver for enabling the reproduction of the neighboring frame information, whereupon the processing and transmission of the redundant speech information is eliminated, and the bit rate can be minimized. A further technical advantage of the invention is that the processing time, or latency, required to encode the speech information at a low data rate is lower than systems heretofore known, and is low enough such that interactive bidirectional communications are possible.

The foregoing technical advantages of the invention are realized by the profile encoding of scalar vector representations of energy, voicing and pitch information of the speech signals. Each scalar is quantized separately over ten frames which comprise a block. A time profile of the speech information is thereby provided.

According to the speech encoder of the invention, speech information is digitized to form frames of speech data having voicing, pitch, energy and spectrum information. Each of the speech parameters are vector quantized to achieve a profile encoding of the speech information. A fixed data rate system is achieved by transmitting the speech parameters in ten-frame blocks. Each 300 millisecond block of speech is represented by 120 bits which are allocated to the noted parameters. Advantage is taken of the spectral dynamics of the speech information by transmitting the spectrum in ten-frame blocks and by replacing the spectral identity of two frames which may be best interpolated by neighboring frames.

A codebook for spectral quantization is created using standard clustering algorithms, with clustering being performed on principal spectral component representations of a linear predictive coding model. Standard KMEANS clustering algorithms are utilized. Spectral data reduction within each N frame block is achieved by substituting interpolated spectral vectors for the actual codebook values whenever such interpolated values closely represent the desired values. Then, only the frame index of the interpolated frames need be transmitted, rather than the complete ten-bit codebook values.

BRIEF DESCRIPTION OF THE DRAWINGS

Further features and advantages will become apparent from the following and more particularly description of the preferred embodiment of the invention, as illustrated in the accompanying drawings in which like reference characters generally refer to the same parts or elements throughout the views, and in which.

DETAILED DESCRIPTION OF THE INVENTION

Figure 1:
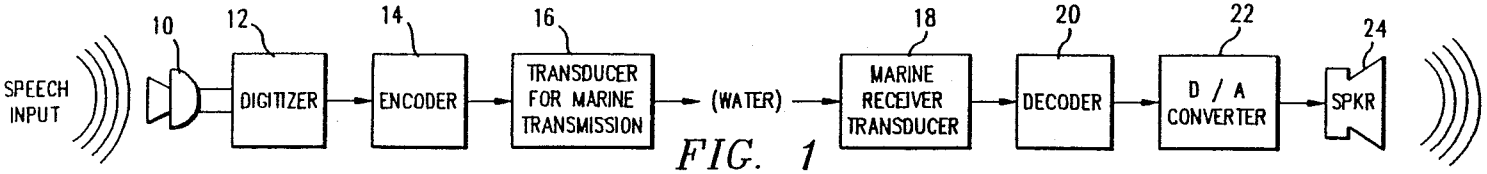
FIG. 1 illustrates an environment in which the present invention may be advantageously practiced.

FIG. 1 illustrates an application of the invention utilized in connection with underwater or marine transmission. Because of such medium for transmitting information from one location to another, the data rate is limited to very low rates, e.g., 200–800 bits per second. Speech information is input to the transmitter portion of the marine transmission system via a microphone 10. The analog audio information is converted into digital form by digitizer 12, and then input to a speech encoder 14. The encoding of the digital information according to the invention will be described in more detail below. The output of the encoder 14 is characterized as digital information transmittable at a very low data rate, such as 400 bits per second. The digital output of the encoder 14 is input to a transducer 16 for converting the low speed speech information for transmission through the marine medium.

The low speed transmission of speech through the marine medium is received at a remote location by a receiver transducer 18 which transforms the encoded speech information into corresponding electrical representations. A decoder or synthesizer 20 receives the electrical signals and conducts a reverse transformation for converting the same into digital speech information. A digital-to-analog converter 22 is effective to convert the digital speech information into analog audio information corresponding to the speech information input into the microphone 10. Such a system constructed in accordance with the invention allows the speech signals to be transmitted and received using a very low bit rate, and without substantially affecting the quality of the speech information. Also, the throughput of the system, from transmitter to receiver, is sufficiently high as to enable the system to be interactive. In other words, the bidirectional transmission and receiving of speech information can be employed in real time so that the latency time is sufficiently short so as not to confuse the speakers and listeners.

Figure 2:
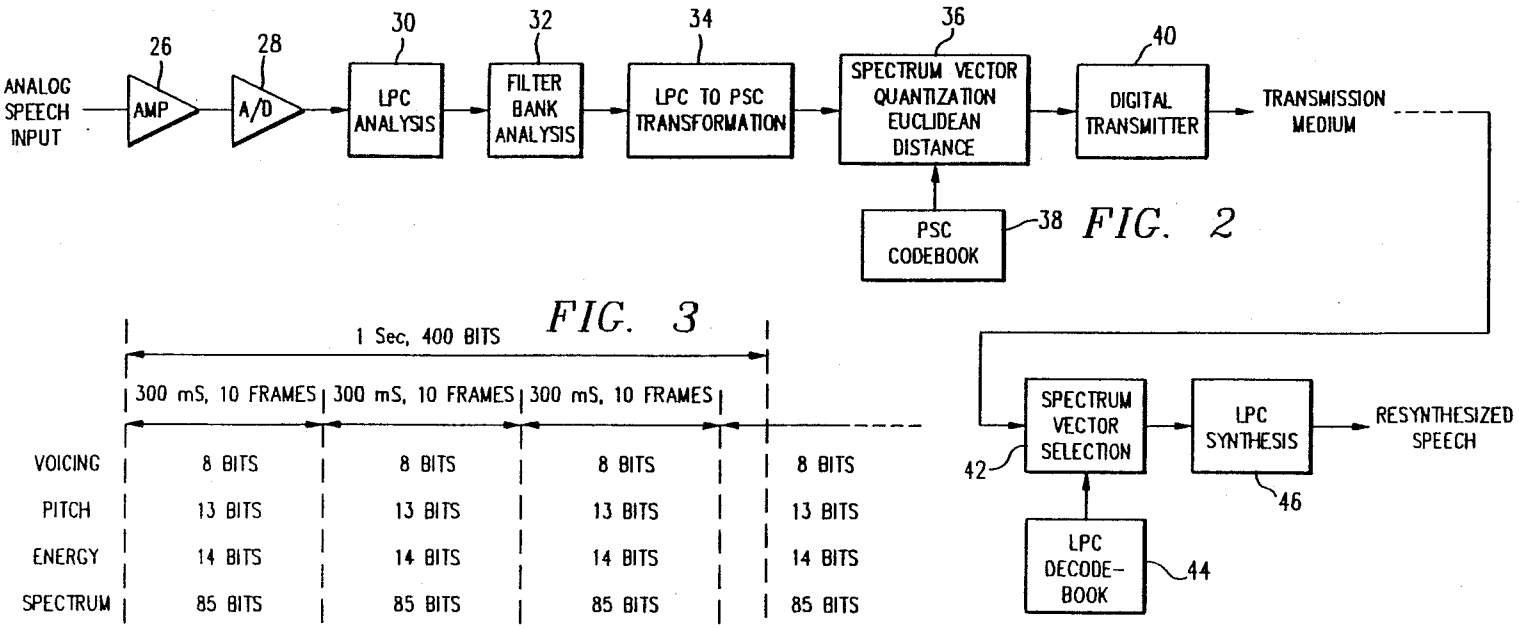
FIG. 2 is a block diagram illustrating the functions of the speech encoder of the invention.

With reference now to FIG. 2, there is illustrated a simplified block diagram of the invention, according to the preferred embodiment thereof. Included in the transmission portion of the system is an analog amplifier 26 for amplifying speech signals and applying the same to an analog-to-digital converter 28. The A/D converter 28 samples the input speech signals at a 8 kHz rate and produces a digital output representative of the amplitude of each sample. While not shown, the speech A/D converter 28 includes a low pass filter for passing only those audio frequencies below about 4 kHz. The digital signals generated by the A/D converter 28 are buffered to temporarily store the digital values for subsequent processing. Next, the series of digitized speech signals are coupled to a linear predictive coding (LPC) analyzer 30 to produce LPC vectors associated with 20 millisecond frame segments. The LPC analyzer 30 is of conventional design, including a signal processor programmed with a conventional algorithm to produce the LPC vectors.

According to conventional LPC analysis, the speech characteristics are assumed to be nonchanging, in a statistical sense, over short periods of time. Thus, 20 millisecond periods are selected to define frame periods to process the voice information. The LPC analyzer 30 provides an output comprising LPC coefficients representative of the analog speech input. In practice 10 LPC coefficients characteristic of the speech signals are output by the analyzer 30. Linear predictive coding analysis techniques and methods of programming thereof are disclosed in a text entitled, *Digital Processing of Speech Signals*, by L. R. Rabiner and R. W. Schafer, Prentice Hall Inc., Inglewood Cliffs, N.J., 1978, Chapter 8 thereof. The subject matter of the noted text is incorporated herein by reference. According to LPC processing, a model of the speech signals is formed according to the following equation:

$$X_n = a_1 x_{n-1} + a_2 x_{n-2} + \ldots + a_p x_{n-p}$$

where x are the sample amplitudes and $a_1$–$a_p$ are the coefficients. In essences, the "a" coefficients describe the system model whose output is known, and the determination is to be made as to the characteristics of a system that produced such output. According to conventional linear predictive coding analysis, the coefficients are determined such that the squared differences, or euclidean distance, between the actual speech sample and the predicted speech sample is minimized. Reflection coefficients are derived which characterize the "a" coefficients, and thus the system model. The reflection coefficients generally designated by the alphabet "k", identify a system whose output is:

$$a_0 = k_1 a_1 + k_2 a_2 \ldots k_{10} a_{10}.$$

An LPC analysis predictor is thereby defined with the derived reflection coefficient value of the digitized speech signal.

The ten linear predictive coding reflection coefficients of each frame are then output to a filter bank 32. In accordance with conventional techniques, the filter bank transforms the LPC coefficients into spectral amplitudes by measuring the response of the input LPC inverse filter at specific frequencies. The frequencies are spaced apart in a logarithmic manner. After the amplitudes have been computed by the filter bank 32, the resulting amplitude vectors are rotated and scaled so that the transformed parameters are statistically uncorrelated and exhibit an identity covariance matrix. This is illustrated by block 34 of FIG. 2. The statistically uncorrelated parameters comprise the principal spectral components (PSC's) of the analog speech information. A euclidean distance in this feature space is then utilized as the metric to compare test vectors with a codebook 38, also comprising vectors. The system arranges the frames in blocks of ten and processes the speech information according to such blocks, rather than according to frames, as was done in the prior art. Each of the scalar vectors of energy, voicing and pitch is then separately vector quantized, as noted below:

$$\text{energy} = \begin{bmatrix} e_1/\bar{e} \\ \cdot \\ \cdot \\ \cdot \\ e_{10}/\bar{e} \end{bmatrix} \text{voice} = \begin{bmatrix} V_1 \\ \cdot \\ \cdot \\ \cdot \\ V_{10} \end{bmatrix} \text{Pitch} = \begin{bmatrix} P_1/\bar{p} \\ \cdot \\ \cdot \\ \cdot \\ P_{10}/\bar{p} \end{bmatrix}$$

As can be seen, a quantized energy vector is computed using the energy of the each of the ten frames. In like manner, voice and pitch vectors are also computed using the voice and pitch parameters of the ten frames. Each of the noted vectors is quantized by considering time as the vector index. In other words, the vector of each of the noted speech parameters is formed starting with the first parameter of interest of the first frame and proceeding to the tenth frame of the block. This procedure essentially quantizes a time profile of each of the noted parameters. As noted, the pitch and energy vectors are computed using the average values of the pitch and energy parameters of each frame.

It can be seen from the foregoing that the block coding is conducted over a number of frames, irrespective of the phonemic boundaries or transition points of the speech sounds. In other words, the coding is conducted for N frames in a block in a routine manner, without necessitating the use of additional specialized algorithms or equipment to determine phonemic boundaries. Next, the spectral vector quantization euclidean distance is compared with a principal spectral component codebook 38, as noted in FIG. 2. The speech encoder of the invention includes a codebook of principal spectral components, rather than prestored LPC vectors, as was done in prior art techniques. The use of principal spectral components as a distance metric improves performance by tailoring features to the statistics of speech production, speaker differences, acoustical environments, channel variations, and thus human speech perception. As a result, the vector quantization process becomes far more stable and versatile under conditions usually catastrophic for vector quantization systems that utilize the LPC likelihood ratio as a distance measure.

The codebook for spectral quantization is developed using standard clustering algorithms, with clustering being performed on the principal spectral component representations of the LPC model. In the preferred form of the invention, a standard KMEANS clustering algorithm is utilized, each cluster being represented in two forms. First, for the purpose of iterating the clustering procedure and for subsequently performing the vector quantization in the speech coding process (transmitter), each cluster is represented by a PSC minimax element of the cluster. The minimax element of a cluster is essentially the cluster element for which the distance to the most remote element in the cluster is minimized. Each cluster is also represented by a set of LPC model parameters, where this model is produced by averaging all cluster elements in the audio correlation domain. This LPC model is employed by the speech decoder (receiver) to resynthesize the speech signal.

Spectral data reduction within each N frame block is achieved by substituting interpolating spectral vectors for the actual codebook values whenever such interpolated values closely represent the desired values. Then, only the frame index of these interpolated values needs to be transmitted, rather than the complete ten-bit codebook values. For example, if it is required that M frames be interpolated, then the distance between the spectral vector for frame k,S(k), and its interpolated value, $S_{int}(k)$, is computed according to the following equation:

$$D_{int}(k) = ||S(k) - S_{int}(k)||,$$

where $$S_{int}(k) = 0.5^* [S_{vq}(k-1)].$$

The M values of k for which $D_{int}(k)$ is minimized are selected as the interpolated frames, where k ranges from 2 to N-1, subject to the restriction that adjacent frames are not allowed to be interpolated. As a typical example, if N is ten and M is two, then there are twenty-one possible pairs of interpolated frames per blocks, and the number of bits required to encode the indices of the interpolated frames is therefore five ($2^5 = 32$). Block encoding is also employed for encoding excitation information. For encoding the voicing information, a histogram can be computed for all 1024 possible voicing vectors. The voicing vector consists of a sequence of ten ones and zeros indicating voice or unvoiced frames. Many of the vectors are quite improbable, and thus the development of a smaller size codebook is possible (e.g., containing only 128 vectors). The size of the final codebook can be determined by the entropy of the full codebook. The Table below illustrates a partial histogram of voicing codebook entries, rank-ordered in decreasing frequency of occurrence. The Table illustrates that the average number of bits of information per ten-frame block is 5.755.

TABLE

| LIKELIHOOD | PROFILE |
|---|---|
| 0.200 | 1111111111 |
| 0.107 | 0000000000 |
| 0.028 | 0111111111 |
| 0.028 | 1111111110 |
| 0.028 | 0011111111 |
| 0.027 | 1111111100 |

TABLE-continued

| LIKELIHOOD | PROFILE |
|---|---|
| 0.024 | 0001111111 |
| 0.024 | 1111111000 |
| 0.018 | 1111110000 |
| 0.018 | 0000111111 |
| 0.014 | 1111100000 |
| 0.013 | 0000011111 |
| 0.012 | 1110001111 |
| 0.011 | 1111000111 |

Note that 3.3 bits are required to perform a complete time indexing of the voicing events to locate an event within a ten-frame block. If, for example, it is anticipated to expend 8 bits on voicing block coding (0.8 bits/frame), then the entropy is under 6 bits per block, thus indicating additional potential savings if a Huffman coding is employed. The distance metric used to compare an input voicing vector with the codebook is a perceptually motivated extension of the Hamming distance. Experimentation with this codebook has verified that the voicing information is retained almost intact.

This method of encoding voice information is instrumental in reducing the necessary bit assignment for encoding the pitch. The pitch is also considered in vectors of length ten, and the unvoiced sections within that vector are eliminated by "bridging" the voiced sections. In particular, if there is an unvoiced section at the beginning or end of the vector, the closest nonzero pitch value is repeated, while an unvoiced section in the middle of the vector is assigned pitch values by interpolating the pitch at the two ends of the section. This method of bridging is successful because the pitch contour demonstrates a very slowly changing behavior, and thus the final vectors are smooth. The pitch is represented logarithmically, and the bridging is also conducted in the logarithmic domain. Once the whole vector is made to represent voiced and pseudo-voiced frames, the contour is normalized by subtracting from the log (pitch) values and their average, log(P). In other words, P represents the geometric mean of the pitch values. In this way, the vectors correspond to different pitch contour patterns, and they are not dependant on the average pitch level of the speaker. Log(P) is quantized separately by a scalar quantizer, and the quantized value is utilized in normalization. A pitch vector is then vector quantized, with a distance metric that gives heavier weight to the voiced sections than to the unvoiced sections. Typical bit allocations for pitch quantization are four bits for block quantization and nine bits for vector quantizing the pitch profile.

Encoding of the energy is performed in a manner analogous to that for pitch and voicing. The individual energy frames within the ten-frame block are first normalized by the average preemphasized RMS frame energy within the block, designated by $E_{norm}$. Then, a pseudo-logarithmic conversion of the normalized frame energy, E(k), is performed, where $$E_{p1}(k)=\mathrm{LOG}[1+\mathrm{Beta}*E(k)/E_{norm}].$$

This nonlinear transformation preserves the perceptually important dynamic range characteristics in the vector quantization process which defines the euclidean distance metric for use in the invention. The resulting ten-frame vector of the normalized and transformed energy profile is then vector quantized. Typical bit allocations for energy quantizations are four bits for block normalization and ten bits for vector quantizing the energy profile.

Figure 3:
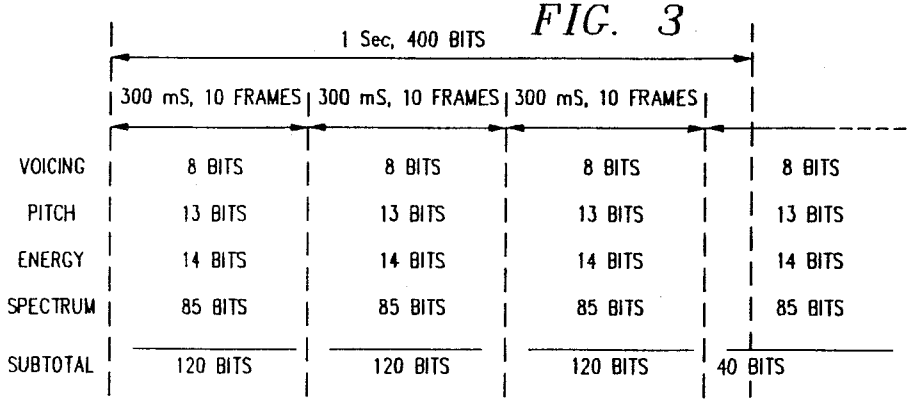
FIG. 3 illustrates the format for encoding speech information according to various parameters.

The bit allocation for each block of ten frames is illustrated in FIG. 3. As noted, the voicing requires eight bits per block, the pitch requires thirteen bits per block, the energy parameter requires fourteen bits per block and the spectrum requires eighty-five bits per block. There are thus 120 bits per ten-frame block which are calculated every 300 milliseconds. Further, for each one second period, 400 bits are output by the digital transmitter 40.

The encoder of the invention may further employ apparatus or an algorithm for discarding frames of information, the speech information of which is substantially similar to adjacent frames. For each frame of information discarded, an index or flag signal is transmitted in lieu thereof to enable the receiver to reinsert decoded signals of the similar speech information. By employing such a technique, the transmission data rate can be further decreased, in that there are fewer bits comprising the flag signals than there are comprising the speech information. The similarity or "informativeness" of a frame of speech information is determined by calculating an euclidean distance between adjacent frames. More specifically, the distance is calculated by finding an average of the frames on each side of a frame of interest, and use the average as an estimator. The similarity of a frame of interest and the estimator is an indication of the "informativeness" of the frame of interest. When each frame is averaged in the manner noted, if its informativeness is below a predefined threshold, then the frame is discarded. On the other hand, if a large euclidean distance is found, the frame is considered to contain different or important speech information not contained in neighboring frames, and thus such frame is retained for transmission.

With reference again to FIG. 2, the receiver section of the very low rate speech decoder includes a spectrum vector selector 42 operating in conjunction with an LPC decode-book 44. The vector selector 42 and decode-book 44 function in a manner similar to that of the transmitter blocks 36 and 38, but rather decode the transmitted digital signals into other signals utilizing the LPC decode-book 44. Transmitted along with the encoded speech information are other signals for use by the receiver in determining which frames have been discarded, as being substantially similar to neighboring frames. With this information, the spectrum vector selector utilizes the LPC decode-book 44 for outputting a digital code in the frame time slots which were discarded in the receiver.

Functional block 46 illustrates an LPC synthesizer, including a digital-to-analog converter (not shown) for transforming the decoded digital signals into audio analog signals. The resynthesis of the digital signals output by the spectrum vector selector 42 are not as easily regenerated by a function which is the converse of that required for encoding the speech information in the transmitter section. The reason for this is that there is no practical method of extracting the PSC components from the LPC parameters. In other words, no inverse transformation exists for converting PSC vectors back into LPC vectors. Therefore, the decoding is completed by utilizing the vector $P_j$ from the cluster of a number of $P_j$'s from which the $|X_j 31\ X_k|$ is minimum. In other words, the euclidean distance between the X and the reference X, e.g., the average of all the cluster values, is minimum.

In the alternative, and having available the $X_j$ components, the $P_j$ vectors are obtained by utilizing the $P_k$ vectors for which the maximum distance between $|X_i - X_j|$ over all i in the set of the cluster values is a minimum. The minimax is determined, taking the maximum distance between any $X_i$ in the selected $X_j$, and selecting the i for which it is minimum.

The time involved in the transmitter and receiver sections of the very low bit rate transmission system in encoding and decoding the speech information is in the order of a half second. This very low latency index allows the system to be interactive, i.e., allows speakers and listeners to communicate with each other without incurring long periods of processing time required for processing the speech information. Of course, with such an interactive system, two transmitters and receivers would be required for transmitting and receiving the voice information at remote locations.

From the foregoing, a very low bit rate speech encoder and decoder have been disclosed for providing enhanced communications at low data rates. While the preferred embodiment of the invention has been disclosed with reference to a specific speech encoder and decoder apparatus and method, it is to be understood that many changes in detail may be made as a matter of engineering choices without departing from the spirit and scope of the invention, as defined by the appended claims.

What is claimed is:

1. A speech encoder, comprising:

a segmenter for segmenting speech information into frames, each having a predetermined time period;

means for computing a quantized energy vector of speech information using a scalar energy parameter for each said frame;

means for computing a quantized voice vector of speech information using a scalar voice parameter for each said frame;

means for computing a quantized pitch vector of speech information using a scalar pitch parameter for each said frame; and means for arranging bits associated with said quantized vectors in a block to provide a profile of speech information over said block.

2. The speech encoder of claim 1 wherein each said computing means computes said energy, voice and pitch vectors separately.

3. The speech encoder of claim 1 further including means for generating a fixed number of bits per block representative of said speech information.

4. The speech encoder of claim 3 further including means for transmitting said bits at a rate of about 400 bits per second, or less.

5. The speech encoder of claim 1 wherein said block comprises a time period of about 300 milliseconds, or less.

6. The speech encoder of claim 5 wherein each said frame comprises about 30 milliseconds.

7. The speech encoder of claim 1 wherein each said block is represented by about 120 bits of data.

8. The speech encoder of claim 1 further including means for determining the similarity of adjacent frames of speech information, and for preventing transmission of speech information of a frame determined to be similar to an adjacent frame.

9. The speech encoder of claim 7 wherein said determining means includes means for determining a euclidean distance of parameters of adjacent frames to determine said similarity.

10. The speech encoder of claim 8 further including means for inserting a flag signal in a frame determined to be similar to an adjacent frame.

11. A fixed data rate speech transmission system, comprising:

means for segmenting speech information into a plurality of frames defining a block;

means for quantizing a voice profile of speech information into a fixed number of bits per block;

means for quantizing a pitch profile of speech information into a fixed number of bits per block;

means for quantizing an energy profile of speech information into a fixed number of bits per block;

means for quantizing a spectrum profile of speech information into a fixed number of bits per block; and means for transmitting said bits as a fixed number of bits for each said block.

12. The transmission system of claim 11 wherein said voice information is transmitted at 27 bits per second, said pitch information is transmitted at 43 bits per second, said energy information is transmitted at 47 bits per second, and said spectrum is transmitted at 283 bits per seconds.

13. The transmission system of claim 11 wherein said voice, pitch, energy and spectrum profiles are vector quantized.

14. A method of encoding speech information, comprising the steps of:

segmenting speech information into a number of predetermined time periods defining frames;

computing a quantized energy vector of speech information for each said frame using a scalar energy parameter;

computing a quantized voice vector of said speech information of each said frame using a scalar voice parameter;

computing a quantized pitch vector of the speech information of each said frame using a scalar pitch parameter; and arranging bits associated with said quantized vectors in a block to provide a profile of speech information over said block of frames.

15. The method of claim 14 further including computing said energy, voice and pitch vectors separately.

16. The method of claim 14 further including generating a fixed number of bits per block representative of said speech information.

17. The method of claim 16 further including transmitting said bits at a data rate of 410 bits per second, or less.

18. The method of claim 17 further including transmitting each said block of bits in a time period of 300 millisecond or more.

19. The method of claim 14 further including transmitting about 120 bits of speech information for each said block.

20. The method of claim 14 further including substituting flag signals in frames of speech information which are similar to other frames of information.

21. A method of encoding and transmitting speech information at a fixed data rate, comprising the steps of:

segmenting speech information into a plurality of frames defining a block;

quantizing a voice profile of speech information into a fixed number of bits per block;

quantizing a pitch profile of speech information into a fixed number of bits per block;

quantizing an energy profile of speech information into a fixed number of bits per block;

quantizing a spectrum profile of speech information into a fixed number of bits per block; and transmitting a fixed number of said bits for each said block.

22. The method of claim 21 further including vector quantizing said voice, pitch, energy and spectrum profiles.

23. The method of claim 21 further including transmitting said speech information at a data rate of 400 bits per second, or less.

24. The method of claim 21 further including encoding said bits using about 120 bits per block.

25. A method of encoding and processing speech information for transmission at a low data rate, comprising the steps of:

converting the speech information in corresponding digital signals segmented into frame intervals;

performing an LPC analysis on each said frame to produce corresponding LPC coefficients;

converting said LPC coefficients into principal spectral components;

vector quantizing different parameters of the speech information associated with a plurality of said frames to produce a vector quantized time profile of said parameters;

comparing adjacent frames of said speech information for informativeness and discarding speech information in frames found to be similar to the speech information of adjacent frames;

correlating the vector quantized parameters into other data using a codebook having principal spectral component vectors; and transmitting an index of a correlated principal spectral component vector at a low data rate.

* * * * *